United States Patent [19]

Bischoff et al.

[11] Patent Number: 4,602,885

[45] Date of Patent: Jul. 29, 1986

[54] IMPLEMENT HOLDING CUFF

[76] Inventors: Steven S. Bischoff; Karen T. Bischoff, both of 3101 Sandalwood Dr., Dunwoody, Ga. 30338

[21] Appl. No.: 697,726

[22] Filed: Feb. 4, 1985

[51] Int. Cl.[4] ..... B43K 29/00

[52] U.S. Cl. ..... 401/6; 15/437; 15/443; 401/8; 401/48; 623/65

[58] Field of Search ..... 401/6, 7, 8, 48; 15/437, 443; 623/65; 224/218

[56] References Cited

U.S. PATENT DOCUMENTS

| | | | |
|---|---|---|---|
| 186,625 | 1/1877 | Ridge | 15/437 X |
| 490,906 | 1/1893 | Helenbolt | 15/437 |
| 507,950 | 10/1893 | Wells | 15/443 |
| 1,336,432 | 4/1920 | Henry | 15/437 |
| 2,501,552 | 3/1950 | Thompson | 401/8 |
| 3,503,546 | 3/1970 | Hunt | 401/8 X |
| 4,511,272 | 4/1985 | Brown et al. | 401/6 |

OTHER PUBLICATIONS

Pp. 7, 11, 57 of Fred Sammons, Inc. Catalog 1984 Professional Self-help Aids.

*Primary Examiner*—Steven A. Bratlie

*Attorney, Agent, or Firm*—James B. Middleton

[57] ABSTRACT

A cuff for assisting a person with poor prehensile ability in holding an implement. The cuff can be made as a flat member having a base plate with a forward extension, and side members extending in opposite directions. The side members are bendable to be formed around the hand of the user. One spring is located adjacent to the base plate between the thumb and the forefinger, and another spring is located generally above the first spring. A pencil or other implement is held between the springs and the cuff for use by the person, the implement being positioned rather naturally for easy use. The forward extension from the base plate supports fingers to prevent flaccid fingers from being uncontrolled during operation of the implement.

7 Claims, 4 Drawing Figures

IMPLEMENT HOLDING CUFF

INFORMATION DISCLOSURE STATEMENT

There are many people with poor prehensile ability due to brain damage, spinal injury and the like. Frequently such people have sufficient control of their arms to carry out many operations, but simply have poor hand control so that the gripping or grasping required for holding implements is difficult or not possible. Many forms of apparatus have been devised to assist such people, from extremely simple cuff devices to elaborate automatic mechanisms.

While the automatic mechanisms are operable by people with very little muscular control, such devices are generally of limited operation, and tend to be quite expensive. The simple cuffs are less expensive and are somewhat operable, but the cuffs are usually awkwardly arranged, and again are generally limited in their use. Other cuffs are designed for particular disabilities, and frequently require a gripping or grasping ability for their use. These, too, are usually designed for a specific function, and are not useable by a person for a variety of functions.

SUMMARY OF THE INVENTION

This invention relates generally to cuffs for use by the physically handicapped, and is more specifically concerned with a widely adjustable cuff receivable on a person's hand for holding an elongate implement in a rather natural position.

The present invention provides a single shapable member to be individually formed by the user. The device is easily formed to fit around a person's hand, and can be bent to conform to either the right hand or left hand depending on the preferred hand of the user. In its simple form, the device of the present invention comprises a base plate having a finger supporting extension, and side members for extending around a person's hand. The implement holding means includes a lower device adjacent to the base plate, and an upper device carried by an extending end of a side member to be disposed adjacent to the back of the user's hand. It is contemplated that the implement holding means will be located adjacent to the user's thumb so that the implement will extend generally perpendicularly to the palm of the hand, the thumb being receivable on one side of the implement while the hand is on the other side of the implement. With this arrangement, the implement is held in a very natural manner without requiring the user to have any gripping ability.

In another embodiment of the invention, the base plate may have a wrist extension for further supporting the device about the user's wrist.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENTS

Figure 1:
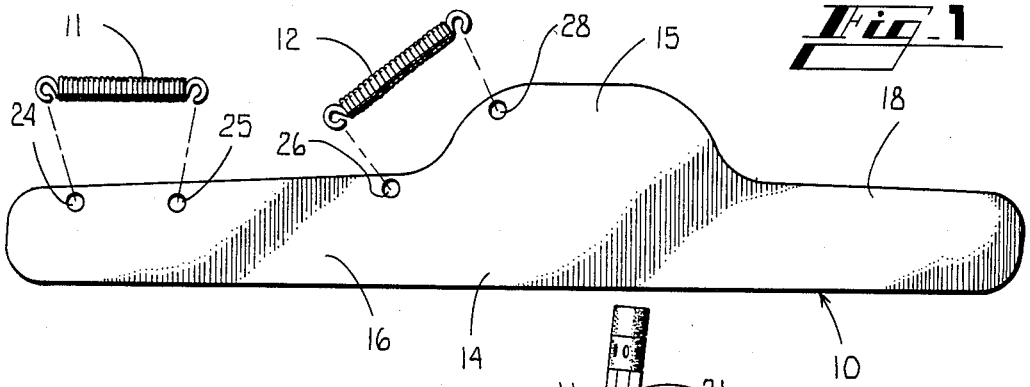
FIG. 1 is a plan view showing a cuff made in accordance with the present invention, the device being shown before bending, and before assembling the implement holding means.

Referring now more particularly to the drawings, and to those embodiments of the invention here presented by way of illustration, in FIG. 1 the cuff is generally indicated at 10, and implement holding devices 11 and 12 are shown exploded from the cuff 10. The cuff 10 is preferably formed of sheet material, so the shape disclosed in FIG. 1 can be simply stamped, perhaps with some edge finishing if required.

As will become better understood hereinafter, the cuff 10 includes a base plate 14, the base plate 14 including a forward extension 15 for supporting the user's fingers. A first side member 16 extends to the left as shown in FIG. 1 of the drawings, and is adapted to be curved to be recieved around the side of the hand having a thumb. A second side member 18 extends to the right as shown in FIG. 1, and is designed to be bent around the opposite side, or back, of the hand. Since the device 10 is simply a piece of flat sheet material, it will be understood that the side pieces 16 and 18 can be bent either upwardly as viewed in FIG. 1, or downwardly. As a result, the device can be bent as required to fit either the left hand or the right hand.

Figure 2:
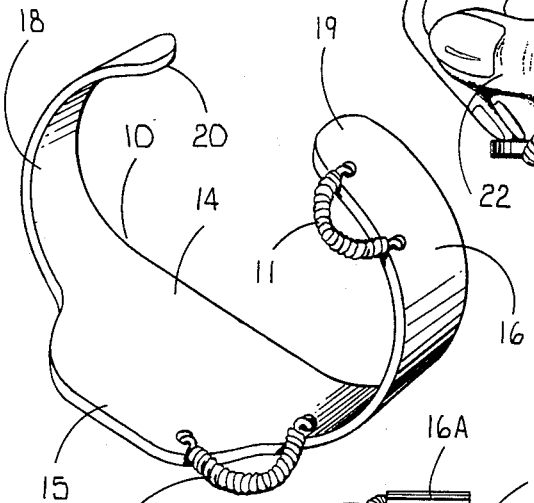
FIG. 2 is a perspective view showing the device of FIG. 1 bent for use by a right-handed person, with the implement holding means assembled.

With attention to FIG. 2 of the drawings, it will be understood that the side member 16 will be curved around the hand, the extending end 19 lying sufficiently on top of the hand to provide reasonable gripping. Similarly, the side member 18 is bent around the opposite side of the hand so that the extending end 20 is sufficiently on top of the hand to hold the cuff 10 in place. With the cuff shaped as shown in FIG. 2, it will be seen that a person's hand can be simply pushed into the cuff 10, flaccid fingers being bent towards the palm and held on the base plate 14, and especially by the extension 15.

Figure 3:
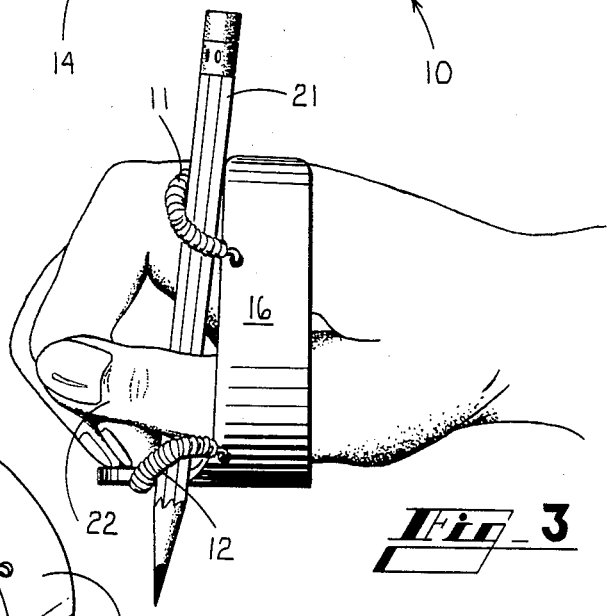
FIG. 3 is a side elevational view of the device shown in FIG. 2, with a hand shown received within the cuff, and an implement received in the implement holding means; and, FIG. 4 is a bottom plan view of a modified form of the invention.

Looking at FIG. 3 of the drawings, the cuff 10 is shown with a pencil 21 received by the implement holding means 11 and 12, and the thumb 22 passing between the side member 16 and the pencil 21. It will be recognized that this is a rather natural position for the hand with respect to the pencil, so writing with a pencil using the cuff 10 of the present invention will be a reasonably natural experience.

It will be seen that the implement holding devices 11 and 12 are here shown as coiled springs. The spring 11 is mounted by having the two end loops of the spring received through holes 24 and 25 in the side member 16, and the implement holding device 12 is attached by having its end coils received through holes 26 and 28. Because the implement holding devices 11 and 12 are coiled springs, it will be understood that a rather wide variety of implements can be received in the implement holding means. While it is contemplated that the springs will be generally uniform, it is quite possible to have various lengths of springs to accommodate extremely large objects if desired. Nevertheless, it will be understood by those skilled in the art that a wide variety of implements to be used on a routine basis could be received by one set of springs. For example, pens and pencils, eating utensils, toothbrush, razors or the like can be held adequately with springs substantially as shown.

Regardless of the implement used with the cuff 10, it will be seen that the implement will be directed with the handle generally perpendicular to the palm of the hand, so the motion for use of the implement will be quite natural. Also, it is an important feature of the present invention that the base plate extension 15 receives the ends of the fingers. In the event a person has flaccid fingers, even though a cuff or the like may allow the person to manipulate an eating utensil, the fingers might drag in the food, which is highly undesirable for the person, as well as creating additional difficulties in cleaning. Other activities may place the fingers in condition for snagging on apparatus, becoming engaged in damaging machinery or the like.

Because of the manner of use of the cuff of the present invention, the person with control of his arms but lack of control of his fingers can shape, or have shaped, the cuff 10 to fit his preferred hand. Once the cuff is appropriately shaped, the person's hand can be simply crammed into the cuff, from the right side as viewed in FIG. 3, and moved toward the left. As a natural result of this motion, the fingers will ride across the base plate 14 and be retained by the extension 15.

Due to the simplicity and versatility of the cuff of the present invention, it will be readily noted that the cuff can be used by a person with virtually no manual ability to allow the person to hold numerous implements. Also, the cuff can be utilized by those with some manual ability, but with limitations. A person with some ability at grasping or gripping can utilize the cuff of the present invention to hold and implement more securely, even though much control is exercised by the user.

Figure 4:
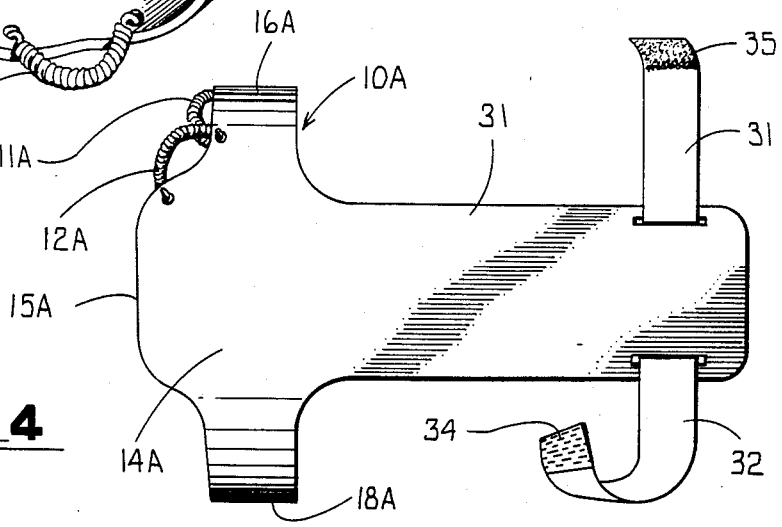

For users with poor wrist control, the embodiment shown in FIG. 4 of the drawings can be utilized. The cuff portion designated at 10A will be constructed precisely as described above, and including a base plate 14A with a forward extension 15A. Implement holding springs 11A and 12A are adjacent to the side 16A, and the opposite side 18A completes the cuff as described. Extending rearwardly from the base plate 14A, there is a wrist extension designated at 30. The wrist extension 30 will be long enough to extend beyond the articulated wrist, and straps 31 and 32 will wrap around the user's arm. As here shown, there is a hook material 34 on the strap 32, and a teazle material 35 on the strap 31. Utilizing the hook and teazle material, the wrist extension 30 can be fixed to the person's arm. With the device installed, it will be understood that the cuff 10A wraps around the person's hand while the straps 31 and 32 wrap around the person's arm with the wrist extension 30 extending along the articulated wrist. The hand will therefore be held sufficiently to allow an implement received in the implement receiving means 11A and 12A to be utilized.

It is contemplated that the cuff 10 or 10A will be formed of malleable aluminum, such material being light in weight and easily formed. Obviously, numerous other materials will suggest themselves to those skilled in the art. Also, the implement holding means may be coiled springs as shown, these being easily replaceable if a spring breaks. However, it will be understood that formed elastic, or plastic materials can be utilized, or tabs having specific shapes for specific implements may be utilized, though this may adversely affect the versatility of the cuff.

It will therefore be understood by those skilled in the art that the particular embodiments of the invention here presented are by way of illustration only, and are meant to be in no way restrictive; therefore, numerous changes and modifications may be made, and the full use of equivalents resorted to, without departing from the spirit or the scope of the invention as defined in the appended claims.

We claim:

1. A cuff for assisting a person having poor prehensile ability to hold implements, said cuff comprising a base plate, an extension of said base plate, a first side member extending from one side of said base plate, and a second side member extending from the opposite side of said base plate, said extension of paid base plate extending forwardly, generally perpendicularly to said side members, said first side member being located adjacent to the thumb of a person's hand received within said cuff, and extending around the side of said hand, said second side member extending around the back of said hand, said first side member and said second side member extending around said hand sufficiently to retain said cuff in place on said hand, and implement holding means carried by said cuff for selectively receiving an implement, the arrangement being such that said hand can be urged into said cuff, moving across said base plate, fingers of said hand being supported on said extension of said base plate, and an implement can be placed into said implement holding means for manipulation by said hand, said implement holding means including a lower implement holding device substantially at the intersection of said base plate and said first side member, and an upper implement holding device carried by said first side member at a location generally above said lower implement holding device, the arrangement being such that an implement held by said upper and lower implement holding devices will extend in a direction approximately perpendicular to said base plate.

2. A cuff as claimed in claim 1, said first side member being curved around said thumb, said implement holding devices being so located with respect to said first side member that an implement received in said implement holding devices will pass between said thumb and said hand.

3. A cuff as claimed in claim 2, said lower implement holding device including a spring having a first end and a second end, said extension of said base plate defining a first hole adjacent to said first side member for receiving said first end of said spring, said first side member defining a second hole adjacent to said base plate for receiving said second end of said spring, said spring being expandable for allowing an implement to be received between said spring and said base plate.

4. A cuff as claimed in claim 3, said upper implement holding device comprising a second spring, ends of said second spring being received in holes in said first side member.

5. A cuff as claimed in claim 4, and further including a wrist extension extending from said base plate in a direction opposite from said extension of said base plate, and strap means for attaching said wrist extension to the arm of the person using said cuff.

6. A cuff for assisting a person having poor prehensile ability to hold implements, said cuff comprising a base plate having a width generally equal to the width of the four fingers of the person's hand, a first side member extending from said base plate and having a width approximately equal to the width of said base plate, a second side member extending from said base plate in alignment with said first side member and extending oppositely therefrom, said first side member and said second side member being bendable for forming around said hand, said first side member having sufficient length to pass around the thumb and engage the top of the hand, said second side member having sufficient length to pass around the opposite side of the hand and engage the top of the hand, and an extension of said base plate for supporting the fingers of the hand, said extension defining a first hole therein adjacent to said first side member, said first side member defining a second hole therein adjacent to said base plate, and a first spring having ends receivable in said first hole and said second hole, said first side member defining a third hole and a fourth hole therein, said third hole and said fourth hole being spaced apart and being so located along said first side member that said third hole and fourth hole will be above said first hole and second hole, a second spring having ends receivable in said third hole and fourth hole.

7. A cuff as claimed in claim 6, and further including a wrist extension extending from said base plate in a direction opposite from said extension, and strap means for attaching said wrist extension to the arm of the person using said cuff.

* * * * *